US010650747B2

(12) United States Patent
Cho et al.

(10) Patent No.: US 10,650,747 B2
(45) Date of Patent: May 12, 2020

(54) DISPLAY DEVICE AND METHOD OF DRIVING THE SAME

(71) Applicant: Samsung Display Co., Ltd., Yongin-si, Gyeonggi-do (KR)

(72) Inventors: Dong Beom Cho, Yongin-si (KR); Hee Bum Park, Yongin-si (KR); Song Yi Han, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 173 days.

(21) Appl. No.: 15/827,461

(22) Filed: Nov. 30, 2017

(65) Prior Publication Data

US 2018/0211602 A1 Jul. 26, 2018

(30) Foreign Application Priority Data

Jan. 25, 2017 (KR) ..... 10-2017-0012020

(51) Int. Cl.

| | |
|---|---|
| ***G09G 3/30*** | (2006.01) |
| ***G09G 3/3258*** | (2016.01) |
| ***G09G 3/3233*** | (2016.01) |
| *G09G 3/36* | (2006.01) |

(52) U.S. Cl.

CPC ..... *G09G 3/3258* (2013.01); *G09G 3/3233* (2013.01); *G09G 3/3607* (2013.01); *G09G 2310/0248* (2013.01); *G09G 2310/0264* (2013.01); *G09G 2310/08* (2013.01)

(58) Field of Classification Search

CPC ..... G09G 3/3258; G09G 3/3607; G09G 3/36; G09G 2310/0264; G09G 2310/08

See application file for complete search history.

(56) References Cited

U.S. PATENT DOCUMENTS

| | | | | |
|---|---|---|---|---|
| 7,733,314 | B2 * | 6/2010 | Cho | G09G 3/3648 345/690 |
| 9,552,783 | B2 | 1/2017 | Kim | |
| 9,721,516 | B2 * | 8/2017 | Kim | G09G 3/3614 |
| 9,870,748 | B2 * | 1/2018 | Choi | G09G 3/3685 |

(Continued)

FOREIGN PATENT DOCUMENTS

| | | | |
|---|---|---|---|
| KR | 1997-0022930 | A | 5/1997 |
| KR | 10-0329463 | B1 | 3/2002 |
| KR | 10-2015-0101512 | A | 9/2015 |

*Primary Examiner* — Vijay Shankar

(74) *Attorney, Agent, or Firm* — Lewis Roca Rothgerber Christie LLP

(57) ABSTRACT

A display device includes: a timing controller to provide data including a pre-emphasis value and an image data value; a gamma reference voltage supplier to selectively supply one of a first gamma reference voltage and a second gamma reference voltage different from the first gamma reference voltage; and a data driver to supply a pre-emphasis voltage, that is generated based on the pre-emphasis value and the first gamma reference voltage, to data lines during a first period of a horizontal period, and to supply a data voltage, that is generated based on the image data value and the second gamma reference voltage, to the data lines during a second period of the horizontal period. The timing controller is to control the gamma reference voltage supplier to supply the first gamma reference voltage during the first period and to supply the second gamma reference voltage during the second period.

18 Claims, 4 Drawing Sheets

(56) References Cited

U.S. PATENT DOCUMENTS

2008/0136761 A1* 6/2008 Hong ..... G09G 3/2022
345/89
2016/0189655 A1* 6/2016 Choi ..... G09G 3/3685
345/215

* cited by examiner

15

| n \ (n-1) | 0 | 8 | 16 | 32 | 48 | 64 | 96 | 224 | 255 |
|---|---|---|---|---|---|---|---|---|---|
| 0 | 0 | 0 | 0 | 0 | 0 | 0 | 0 | 0 | 0 |
| 8 | 8 | 8 | 4 | 4 | 4 | 4 | 3 | 3 | 2 |
| 16 | 17 | 16 | 16 | 14 | 14 | 14 | 13 | 10 | 6 |
| 32 | 45 | 42 | 34 | 32 | 32 | 31 | 31 | 21 | 13 |
| 48 | 67 | 63 | 56 | 50 | 48 | 47 | 43 | 27 | 16 |
| 64 | 86 | 82 | 70 | 68 | 66 | 64 | 60 | 32 | 19 |
| 96 | 129 | 117 | 112 | 107 | 102 | 98 | 96 | 71 | 29 |
| 224 | 245 | 236 | 234 | 232 | 230 | 228 | 226 | 224 | 201 |
| 255 | 255 | 255 | 255 | 255 | 255 | 255 | 255 | 255 | 255 |

Falling

Rising

DISPLAY DEVICE AND METHOD OF DRIVING THE SAME

CROSS-REFERENCE TO RELATED APPLICATION

This application claims priority to, and the benefit of, Korean Patent Application No. 10-2017-0012020, filed on Jan. 25, 2017, in the Korean Intellectual Property Office, the entire content of which is incorporated herein by reference in its entirety.

BACKGROUND

1. Field

One or more aspects of example embodiments of the present invention relate to a display device and a method of driving the same.

2. Description of the Related Art

Recently, various display devices capable of reducing weights and volumes, which may be disadvantages of cathode ray tubes (CRT), are being developed. The display devices include a liquid crystal display (LCD), a field emission display (FED), a plasma display panel (PDP), and/or an organic light emitting display (OLED).

The display device includes pixels positioned at crossing regions of gate lines and data lines, a gate driver for driving the gate lines, and a data driver for driving the data lines.

The gate driver selects pixels in units of lines, while sequentially supplying gate signals to the gate lines. The data driver supplies data signals to the data lines in synchronization with the gate signals. At this time, the pixels selected by the gate signals charge voltages corresponding to the data signals. The pixels that charge the voltages corresponding to the data signals display an image with a predetermined brightness in response to the data signals.

In order for the display device to stably display the image, the data signals may be stably supplied to the pixels within a predetermined time (that is, a time for which the gate signals are supplied). However, due to increase in resolution and a size of a panel, in a period in which the gate signals are supplied, the data signals may not be sufficiently charged or discharged at a desired voltage (a target voltage).

The above information disclosed in this Background section is for enhancement of understanding of the background of the invention, and therefore, it may contain information that does not constitute prior art.

SUMMARY

One or more aspects of example embodiments of the present invention are directed toward a method of temporarily supplying a pre-emphasis voltage having a higher level than that of a data voltage so that driving delay time may be reduced.

According to an example embodiment of the present invention, a display device includes: a timing controller configured to provide data including a pre-emphasis value and an image data value; a gamma reference voltage supplier configured to selectively supply one of a first gamma reference voltage and a second gamma reference voltage different from the first gamma reference voltage; and a data driver configured to supply a pre-emphasis voltage, that is generated based on the pre-emphasis value and the first gamma reference voltage, to data lines during a first period of a horizontal period, and to supply a data voltage, that is generated based on the image data value and the second gamma reference voltage, to the data lines during a second period of the horizontal period. The timing controller is configured to control the gamma reference voltage supplier to supply the first gamma reference voltage during the first period and to supply the second gamma reference voltage during the second period.

Each of the first and second gamma reference voltages may include a lowest gamma reference voltage corresponding to a low grayscale value, and a highest gamma reference voltage corresponding to a high grayscale value.

The lowest gamma reference voltage of the first gamma reference voltage may be lower in level than the lowest gamma reference voltage of the second gamma reference voltage, and the highest gamma reference voltage of the first gamma reference voltage may be higher in level than the highest gamma reference voltage of the second gamma reference voltage.

The timing controller may be configured to compare the image data value of a previous horizontal period with the image data value of a current horizontal period, and to determine the pre-emphasis value of the current horizontal period.

The timing controller may be configured to control the gamma reference voltage supplier to supply the first gamma reference voltage during the first period when a difference between the image data value of the previous horizontal period and the image data value of the current horizontal period is greater than or equal to a reference value, and to supply the second gamma reference voltage during the first period when the difference between the image data value of the previous horizontal period and the image data value of the current horizontal period is less than the reference value.

The timing controller may be configured to determine pre-emphasis values based on a look-up table in which the pre-emphasis values corresponding to the image data value of a previous horizontal period and the image data value of a current horizontal period are stored.

The look-up table may include a low grayscale values group including a lowest grayscale value, and a high grayscale values group including a highest grayscale value.

The timing controller may be configured to control the gamma reference voltage supplier to supply the first gamma reference voltage during the first period, when it is determined that the image data value of the previous horizontal period is included in one of the low grayscale values group and the high grayscale values group, and the image data value of the current horizontal period is included in the other of the low grayscale values group and the high grayscale values group.

The data driver may include a grayscale voltage generator configured to divide the first gamma reference voltage or the second gamma reference voltage, and to generate a plurality of grayscale voltages.

The data driver may be configured to generate the pre-emphasis voltage by selecting one of the grayscale voltages from among the grayscale voltages corresponding to the pre-emphasis value, and to generate the data voltage by selecting one of the grayscale voltages from among the grayscale voltages corresponding to the image data value.

The display device may further include: a gate driver configured to supply gate signals through gate lines; and a pixel unit including a plurality of pixels connected to the gate lines and the data lines.

According to an example embodiment of the present invention, a method of driving a display device includes: providing data including a pre-emphasis value and an image data value; selectively supplying a first gamma reference voltage and a second gamma reference voltage different from the first gamma reference voltage; and supplying a pre-emphasis voltage, that is generated based on the pre-emphasis value and the first gamma reference voltage, to data lines during a first period of a horizontal period, and supplying a data voltage generated, that is based on the image data value and the second gamma reference voltage, to the data lines during a second period of the horizontal period. In the selectively supplying of the first gamma reference voltage and the second gamma reference voltage, the first gamma reference voltage is supplied during the first period, and the second gamma reference voltage is supplied during the second period.

Each of the first and second gamma reference voltages may include a lowest gamma reference voltage corresponding to a low grayscale value and a highest gamma reference voltage corresponding to a high grayscale value.

The lowest gamma reference voltage of the first gamma reference voltage may be lower in level than the lowest gamma reference voltage of the second gamma reference voltage, and the highest gamma reference voltage of the first gamma reference voltage may be higher in level than the highest gamma reference voltage of the second gamma reference voltage.

The method may further include determining the pre-emphasis values based on a look-up table in which the pre-emphasis values corresponding to the image data value of a previous horizontal period and the image data value of a current horizontal period are stored.

The look-up table may include a low grayscale values group including a lowest grayscale value, and a high grayscale values group including a highest grayscale value.

The selectively supplying of the first gamma reference voltage and the second gamma reference voltage may include supplying the first gamma reference voltage during the first period, when it is determined that the image data value of the previous horizontal period is included in one of the low grayscale values group and the high grayscale values group, and the image data value of the current horizontal period is included in the other of the low grayscale values group and the high grayscale values group.

According to an example embodiment of the present invention, a system of driving a display device includes: means for providing data including a pre-emphasis value and an image data value; means for selectively supplying a first gamma reference voltage and a second gamma reference voltage different from the first gamma reference voltage; and means for supplying a pre-emphasis voltage, that is generated based on the pre-emphasis value and the first gamma reference voltage, to data lines during a first period of a horizontal period, and supplying a data voltage generated, that is based on the image data value and the second gamma reference voltage, to the data lines during a second period of the horizontal period. In the selectively supplying of the first gamma reference voltage and the second gamma reference voltage, the first gamma reference voltage is supplied during the first period, and the second gamma reference voltage is supplied during the second period.

BRIEF DESCRIPTION OF THE DRAWINGS

The above and other aspects and features of the present inventive concept will be more clearly understood from the following detailed description of the illustrative, non-limiting example embodiments with reference to the accompanying drawings.

DETAILED DESCRIPTION

Figure 1:
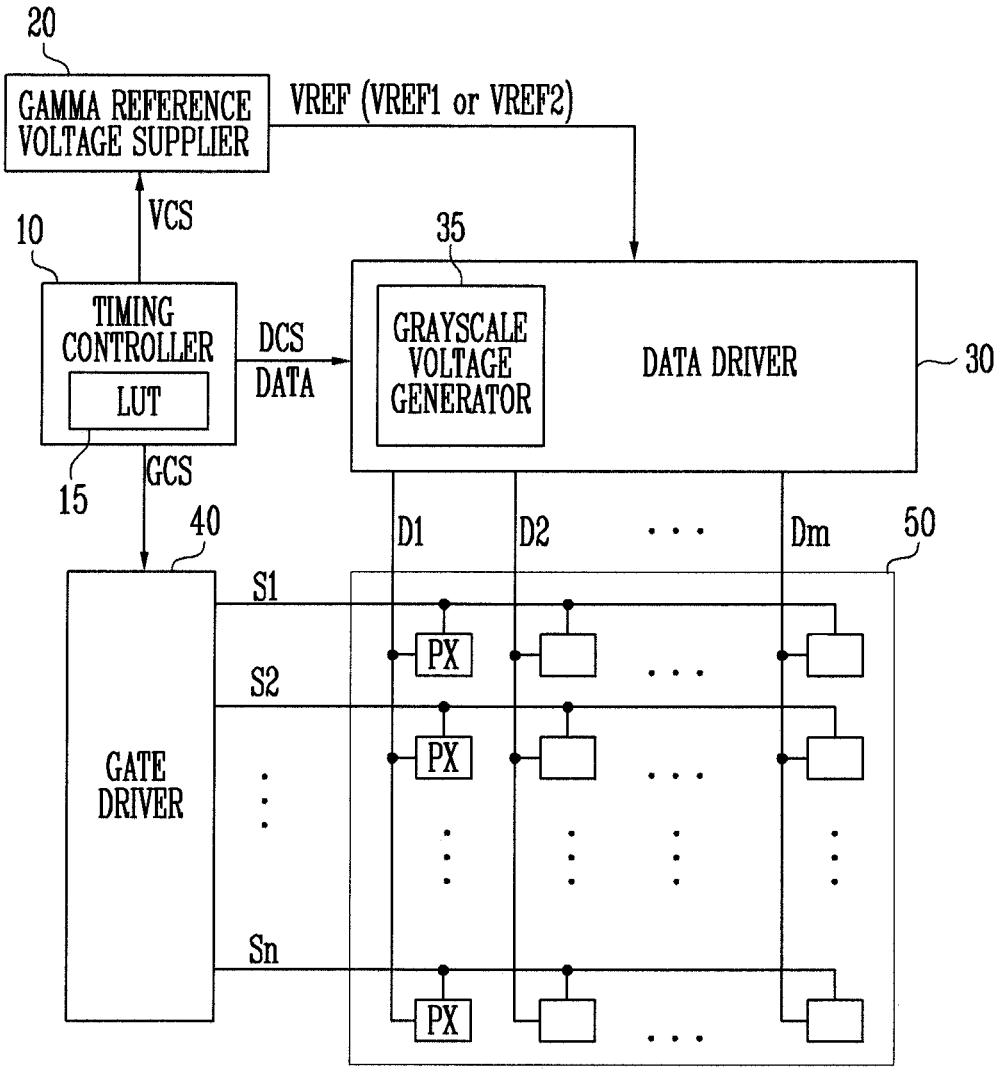
FIG. 1 is a block diagram schematically illustrating a display device according to an embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram schematically illustrating a display device according to an embodiment of the present invention.

Referring to FIG. 1, a display device, according to an embodiment of the present invention, may include a timing controller 10, a gamma reference voltage supplier 20, a data driver 30, a gate driver 40, and a pixel unit (e.g., a display panel or region) 50.

The timing controller 10 receives synchronizing signals and a clock signal for controlling image data and display of the image data. The timing controller 10 corrects the image data input from the outside to be suitable for image display of the pixel unit 50, and supplies the corrected data DATA to the data driver 30. The data DATA includes an image data value for the image display, and a pre-emphasis value for applying pre-emphasis to the image data value.

The timing controller 10 may output a data control signal DCS for controlling operation timing of the data driver 30, and a gate control signal GCS for controlling operation timing of the gate driver 40. In addition, the timing controller 10 may output a voltage control signal VCS for controlling operation timing of the gamma reference voltage supplier 20, and for controlling a voltage level of a gamma reference voltage VREF.

The gamma reference voltage supplier 20 supplies the gamma reference voltage VREF to the data driver 30. The gamma reference voltage VREF includes a first gamma reference voltage VREF1 and a second gamma reference voltage VREF2 that is different from the first gamma reference voltage VREF1. Here, each of the first gamma reference voltage VREF1 and the second gamma reference voltage VREF2 may include the lowest gamma reference voltage corresponding to the lowest grayscale value and the highest gamma reference voltage corresponding to the highest grayscale value.

The gamma reference voltage supplier 20 selectively supplies one of the first gamma reference voltage VREF1 and the second gamma reference voltage VREF2. For this purpose, the gamma reference voltage supplier 20 may change the voltage level of the gamma reference voltage VREF. The gamma reference voltage supplier 20 increases or reduces the voltage level of the gamma reference voltage VREF in response to the voltage control signal VCS of the timing controller 10, and may output the increased or reduced voltage level.

According to an embodiment, the gamma reference voltage supplier 20 may include a DC-DC converter and a pulse-width modulation (PWM) controller, and may include (or be formed of) one or more circuits capable of generating the gamma reference voltage VREF and changing the voltage level of the gamma reference voltage VREF.

The data driver 30 is connected to data lines D1 through Dm (wherein m is a natural number), and supplies data signals to the pixel unit 50 through the data lines D1 through Dm. The data driver 30 converts the data DATA supplied from the timing controller 10 into a voltage (e.g., an analog data signal). The data driver 30 outputs a grayscale voltage (e.g., a voltage of a grayscale level) corresponding to the data DATA in response to the data control signal DCS of the timing controller 10. Here, the data DATA includes the pre-emphasis value and the image data value.

The data driver 30 receives one of the first gamma reference voltage VREF1 and the second gamma reference voltage VREF2 from the gamma reference voltage supplier 20.

The data driver 30 supplies a pre-emphasis voltage generated based on the pre-emphasis value and the first gamma reference voltage VREF1 to the data lines D1 through Dm during a first period of a horizontal period. In addition, the data driver 30 supplies a data voltage generated based on the image data value and the second gamma reference voltage VREF2 to the data lines D1 through Dm during a second period of the horizontal period. The data signals include the pre-emphasis voltage and the data voltage.

According to an embodiment, the data driver 30 may include a grayscale voltage generator 35 for dividing the first gamma reference voltage VREF1 and/or the second gamma reference voltage VREF2, and for generating a plurality of grayscale voltages. The data driver 30 generates the pre-emphasis voltage by selecting one of the grayscale voltages from among the grayscale voltages corresponding to the pre-emphasis value, and may generate the data voltage by selecting one of the grayscale voltages from among the grayscale voltages corresponding to the image data value.

The gate driver 40 is connected to gate lines S1 through Sn (where n is a natural number), and supplies gate signals to the pixel unit 50 through the gate lines S1 through Sn. For example, the gate driver 40 shifts a level of a gate voltage in response to a gate control signal GCS of the timing controller 10, and outputs the gate signals. According to an embodiment, the gate driver 40 may include (or be formed of) a plurality of stage circuits, and may sequentially supply the gate signals to the gate lines S1 through Sn.

The pixel unit 50 displays an image in response to the data signals supplied from the data driver 30 and the gate signals supplied from the gate driver 40. The pixel unit 50 includes a plurality of pixels PX connected to the gate lines S1 through Sn and the data lines D1 through Dm, and may be arranged in a matrix.

In more detail, the pixels PX are selected in units of horizontal lines in response to a gate signal supplied to one of the gate lines S1 through Sn. Each of the pixels PX selected by the gate signal receives a data signal from a corresponding data line (e.g., one of D1 through Dm) connected thereto. Each of the pixels PX that receives the data signal emits light with a brightness (e.g., a set or predetermined brightness) corresponding to the data signal.

According to an embodiment, the pixel unit 50 may be a liquid crystal display (LCD) panel. However, the present invention is not limited thereto. For example, the pixel unit 50 may be implemented by any one of various suitable display panels, such as an organic light emitting display (OLED) panel.

In order for the pixel unit 50 to stably display an image, the data signals may be stably supplied to the pixels PX within a predetermined time (that is, a period in which the gate signals are supplied). However, due to increase in resolution and a panel size, during the period in which the gate signals are supplied, the data signals may not be sufficiently charged or discharged at a desired voltage (e.g., a target voltage).

In order to solve the problem, a method of supplying a pre-emphasis voltage larger than the data voltage is suggested. However, the related art pre-emphasis driving method has a problem in which the pre-emphasis voltage larger than the data voltage may not be applied during a data change between the lowest grayscale level and the highest grayscale level.

The display device according to one or more embodiments of the present invention may apply the pre-emphasis voltage larger than the data voltage despite of the data change between the lowest grayscale level and the highest grayscale level, by supplying the pre-emphasis voltage that is generated based on the first gamma reference voltage VREF1 during the first period of the horizontal period, and by supplying the data voltage generated based on the second gamma reference voltage VREF2 different from the first gamma reference voltage VREF1 during the second period of the horizontal period.

For this purpose, the timing controller 10 controls the gamma reference voltage supplier 20 to supply the first gamma reference voltage VREF1 during the first period and to supply the second gamma reference voltage VREF2 during the second period.

The timing controller 10 may determine the pre-emphasis value. In more detail, the timing controller 10 compares the image data value for a previous horizontal period with the image data value for a current horizontal period, and may determine the pre-emphasis value corresponding to the current horizontal period. The timing controller 10 may change a portion of the image data value into the determined pre-emphasis value.

According to an embodiment, the timing controller 10 may control the gamma reference voltage supplier 20 to supply the second gamma reference voltage VREF2 during a data change between intermediate grayscale values, and to supply the first gamma reference voltage VREF1 during the data change between the lowest grayscale value and the highest grayscale value as a result of comparing the image data values.

In more detail, the timing controller 10 may control the gamma reference voltage supplier 20 to supply the first gamma reference voltage VREF1 during the first period when a difference between the image data value for the previous horizontal period and the image data value for the current horizontal period is greater than or equal to a reference value. In addition, the timing controller 10 may control the gamma reference voltage supplier 20 to supply the second gamma reference voltage VREF2 during the first period when the difference between the image data value for the previous horizontal period and the image data value for the current horizontal period is less than the reference value.

According to an embodiment, the timing controller 10 may determine the pre-emphasis grayscale value based on the look-up table 15 in which the pre-emphasis value corresponding to the image data value for the previous horizontal period and the image data value for the current horizontal period is identified (or stored). In the look-up table 15, the values may be experimentally or statistically set in accordance with a tuning result of testing the display device.

The look-up table 15 may include a low grayscale values group including the lowest grayscale value, and a high grayscale values group including the highest grayscale value. When it is determined that the image data value for the previous horizontal period is included in one of the low grayscale values group and the high grayscale values group, and the image data value for the current horizontal period is included in the other of the low grayscale values group and the high grayscale values group, the timing controller 10 may control the gamma reference voltage supplier 20 to supply the first gamma reference voltage VREF1 during the first period. The look-up table 15 will be described in more detail with reference to FIG. 3.

Figure 2A:
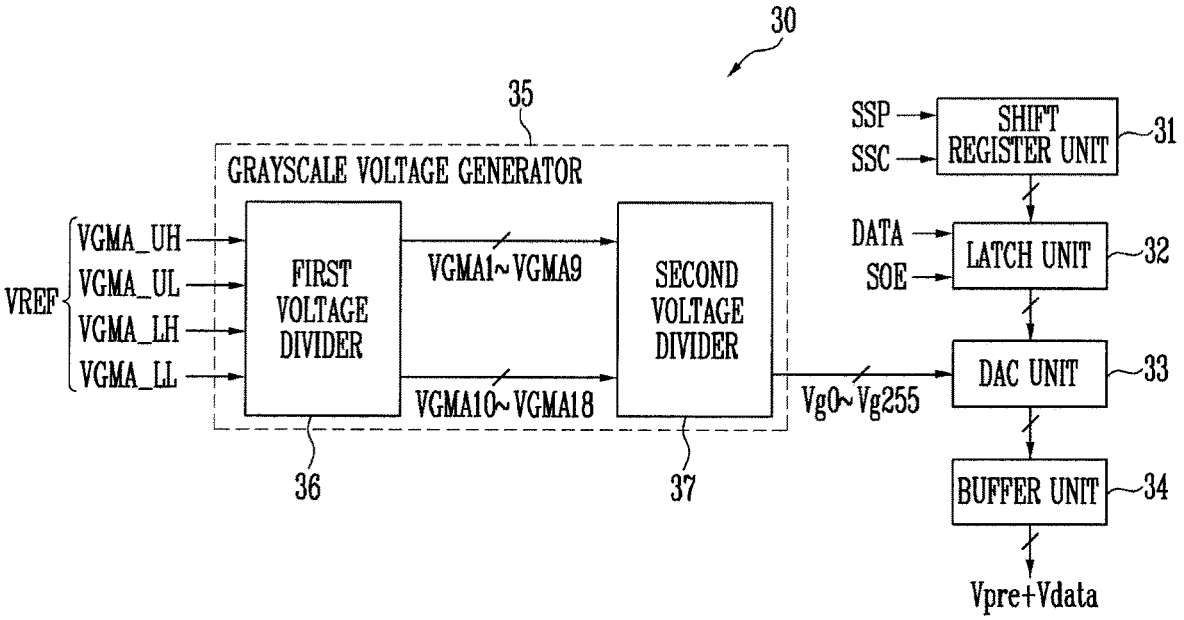
FIG. 2A is a detailed block diagram of the data driver of FIG. 1.
Figure 2B:
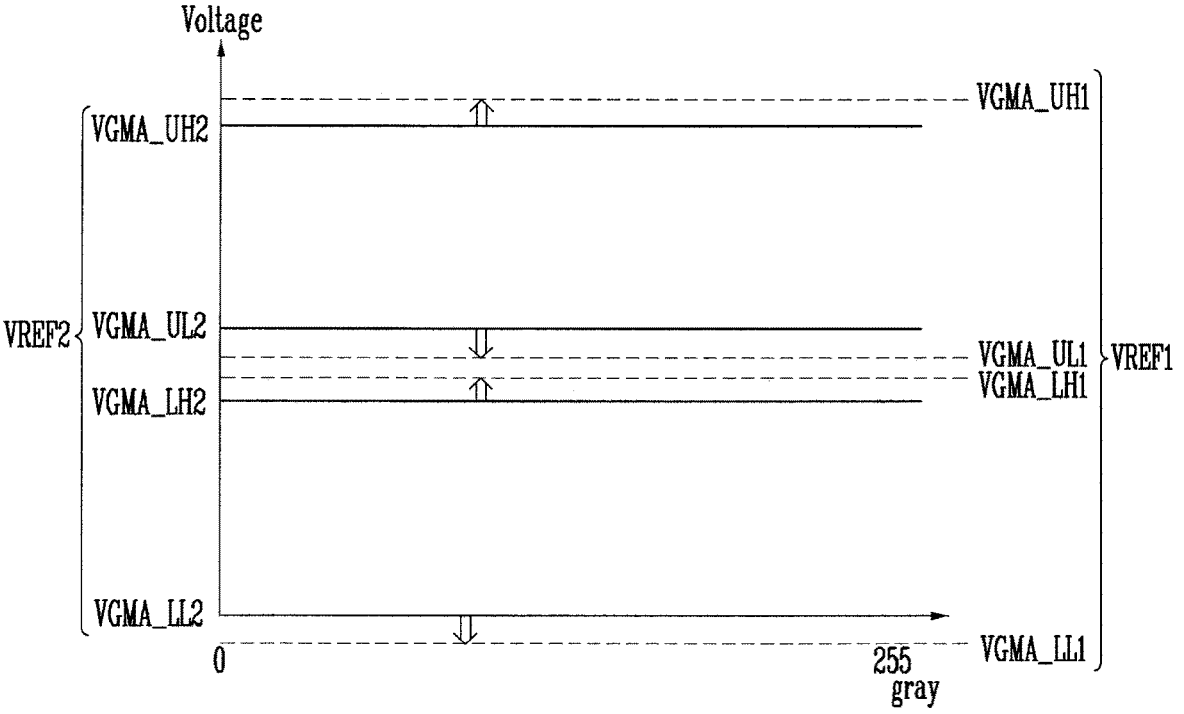
FIG. 2B is a view illustrating levels of a first gamma reference voltage and a second gamma reference voltage.

FIG. 2A is a detailed block diagram of the data driver of FIG. 1. FIG. 2B is a view illustrating levels of a first gamma reference voltage and a second gamma reference voltage.

First, referring to FIG. 2A, the data driver 30 may include a shift register unit (e.g., a shift register) 31, a latch unit (e.g., a latch) 32, a digital-to-analog converter (DAC) unit (e.g., a digital-to-analog converter) 33, a buffer unit (e.g., a buffer) 34, and a grayscale voltage generator 35.

The shift register unit 31 sequentially generates sampling signals while shifting a source start pulse SSP provided from the timing controller 10 in accordance with a source shift clock SSC during one horizontal period. For this purpose, the shift register unit 31 may include a plurality of shift registers.

The latch unit 32 may include a first latch unit (e.g., a first latch) for sequentially latching the data DATA provided from the timing controller 10 in response to the sampling signals provided from the shift register unit 31, and a second latch unit (e.g., a second latch) for latching the data of one horizontal line that are latched by the first latch unit in parallel at a rise point of a source output enable (SOE) signal, and supplying the latched data to the DAC unit 33.

The DAC unit 33 generates an analog data voltage corresponding to the digital data DATA when the latched data are input from the latch unit 32, and outputs the analog data voltage to the buffer unit 34. At this time, the DAC unit 33 receives grayscale voltages Vg0 through Vg255 from the grayscale voltage generator 35, and generates a pre-emphasis voltage Vpre and a data voltage Vdata corresponding to the data DATA. For this purpose, the DAC unit 33 may include a plurality of DACs.

The buffer unit 34 supplies the pre-emphasis voltage Vpre and the data voltage Vdata that are supplied from the DAC unit 33 to each of the data lines D1 through Dm. The buffer unit 34 includes a plurality of output buffers respectively connected to the data lines D1 through Dm, and the output buffers may include (or be formed of) operating amplifiers.

The grayscale voltage generator 35 divides the gamma reference voltage VREF, and generates the grayscale voltages Vg0 through Vg255. Here, the gamma reference voltage VREF may include a positive polar high gamma reference voltage VGMA_UH, a positive polar low gamma reference voltage VGMA_UL, a negative polar high gamma reference voltage VGMA_LH, and a negative polar low gamma reference voltage VGMA_LL.

For example, in an inversion driving method of a liquid crystal display device, levels of the positive polar high gamma reference voltage VGMA_UH and the positive polar low gamma reference voltage VGMA_UL are larger than a level of a common voltage, and levels of the negative polar high gamma reference voltage VGMA_LH and the negative polar low gamma reference voltage VGMA_LL are smaller than the level of the common voltage. The positive polar high gamma reference voltage VGMA_UH and the negative polar low gamma reference voltage VGMA_LL correspond to the highest grayscale value, and the positive polar low gamma reference voltage VGMA_UL and the negative polar high gamma reference voltage VGMA_LH correspond to the lowest grayscale value.

According to an embodiment, the grayscale voltage generator 35 may include a first voltage divider 36 for dividing the gamma reference voltage VREF and for generating intermediate gamma reference voltages VGMA1 through VGMA18, and a second voltage divider 37 for dividing the intermediate gamma reference voltages VGMA1 through VGMA18 and for generating the grayscale voltages Vg0 through Vg255.

The first voltage divider 36 divides the positive polar high gamma reference voltage VGMA_UH and the positive polar low gamma reference voltage VGMA_UL by using a plurality of serially connected resistance elements (e.g., resistors), and may generate positive polar intermediate gamma reference voltages VGMA1 through VGMA9. The first voltage divider 36 divides the negative polar high gamma reference voltage VGMA_LH and the negative polar low gamma reference voltage VGMA_LL by using the plurality of serially connected resistance elements, and may generate negative polar intermediate gamma reference voltages VGMA10 through VGMA18.

The second voltage divider 37 divides the intermediate gamma reference voltages VGMA1 through VGMA18 by using a plurality of serially connected resistance elements (e.g., resistors), and may generate the grayscale voltages Vg0 through Vg255.

The structures of the data driver 30 and the grayscale voltage generator 35 are not limited thereto, and may suitably vary so long as the grayscale voltages Vg0 through Vg255 are generated from the gamma reference voltage VREF, and the pre-emphasis voltage Vpre and the data voltage Vdata may be output based on the grayscale voltages Vg0 through Vg255 and the data DATA.

Referring to FIG. 2B, a level of the lowest gamma reference voltage (e.g., VGMA_LL1) of the first gamma reference voltage VREF1 is smaller than a level of the lowest gamma reference voltage (e.g., VGMA_LL2) of the second gamma reference voltage VREF2, and a level of the highest gamma reference voltage (e.g., VGMA_UH1) of the first gamma reference voltage VREF1 is larger than a level of the highest gamma reference voltage (e.g., VGMA_UH2) of the second gamma reference voltage VREF2.

Here, the first gamma reference voltage VREF1 may include a first positive polar high gamma reference voltage VGMA_UH1, a first positive polar low gamma reference voltage VGMA_UL1, a first negative polar high gamma reference voltage VGMA_LH1, and a first negative polar low gamma reference voltage VGMA_LL1. The second gamma reference voltage VREF2 may include a second positive polar high gamma reference voltage VGMA_UH2, a second positive polar low gamma reference voltage VGMA_UL2, a second negative polar high gamma reference voltage VGMA_LH2, and a second negative polar low gamma reference voltage VGMA_LL2.

The first gamma reference voltage VREF1 may include a maximum value in a voltage range for which grayscale level voltages may be generated. Therefore, a level of the first positive polar high gamma reference voltage VGMA_UH1 is set to be larger than a level of the second positive polar high gamma reference voltage VGMA_UH2, and a level of the first negative polar low gamma reference voltage VGMA_LL1 is set to be smaller than a level of the second negative polar low gamma reference voltage VGMA_LL2. In addition, a level of the first positive polar low gamma reference voltage VGMA_UL1 is set to be smaller than a level of the second positive polar low gamma reference voltage VGMA_UL2, and a level of the first negative polar high gamma reference voltage VGMA_LH1 is set to be larger than a level of the second negative polar high gamma reference voltage VGMA_LH2.

According to an embodiment, based on a driving voltage for generating the gamma reference voltage VREF and a common voltage for driving the liquid crystal display device, the first positive polar high gamma reference voltage VGMA_UH1 may be set to be lower than the driving voltage by, for example, 0.2V, the first positive polar low gamma reference voltage VGMA_UL1 may be set to be higher than the common voltage by, for example, 0.2V, the first negative polar high gamma reference voltage VGMA_LH1 may be set to be lower than the common voltage by, for example, 0.2V, and the first negative polar low gamma reference voltage VGMA_LL1 may be set to be higher than ground by, for example, 0.2V.

For example, when the driving voltage is 17V and the common voltage is 8.5V, the first positive polar high gamma reference voltage VGMA_UH1 may be set as 16.8V, the first positive polar low gamma reference voltage VGMA_UL1 may be set as 8.7V, the first negative polar high gamma reference voltage VGMA_LH1 may be set as 8.3V, and the first negative polar low gamma reference voltage VGMA_LL1 may be set as 0.2V.

In addition, when the driving voltage is 17V and the common voltage is 8.5V, for example, the second positive polar high gamma reference voltage VGMA_UH2 may be set as 16.5V, the second positive polar low gamma reference voltage VGMA_UL2 may be set as 9V, the second negative polar high gamma reference voltage VGMA_LH2 may be set as 8V, and the second negative polar low gamma reference voltage VGMA_LL2 may be set as 0.5V.

Figures 3, 4:
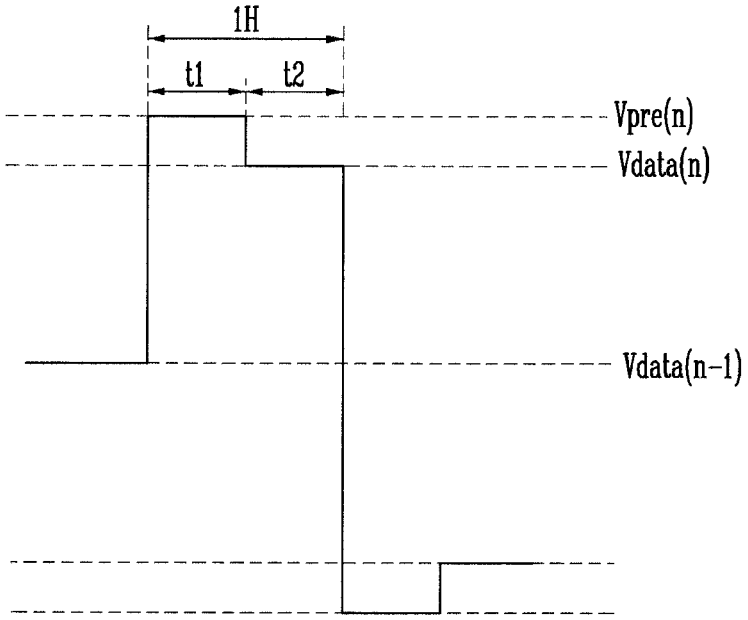
FIG. 3 is a look-up table according to an embodiment of the present invention.
FIG. 4 is a waveform diagram illustrating a pre-emphasis voltage and a data voltage.

FIG. 3 is a look-up table according to an embodiment of the present invention. FIG. 4 is a waveform diagram illustrating a pre-emphasis voltage and a data voltage.

First, referring to FIG. 3, n columns (where n is a natural number) of the look-up table 15 represent the image data values of the current horizontal period and (n−1) rows of the look-up table 15 represent the image data values of the previous horizontal period. Data values corresponding to the image data values of the current horizontal period and the image data values of the previous horizontal period represent pre-emphasis values. All the data values of the look-up table 15 represent levels of grayscales.

Because the image data values of the current horizontal period and the image data values of the previous horizontal period are equal to each other in a diagonal direction of the look-up table 15, there are no change in voltage levels of data signals. Because transition from low grayscale values to high grayscale values occurs at a left lower end in the diagonal direction, the left lower end corresponds to a rising edge at which the voltage levels of the data signals increase. Since transition from high grayscale values to low grayscale values occurs at a right upper end in the diagonal direction, the right upper end corresponds to a falling edge at which the voltage levels of the data signals are reduced.

Referring to FIG. 4 together with FIG. 3, the data driver 30 supplies the pre-emphasis voltage Vpre, generated based on the pre-emphasis values and the first gamma reference voltage VREF1, to the data lines D1 through Dm during the first period t1 of the horizontal period 1H. In addition, the data driver 30 supplies the data voltage Vdata, generated based on the image data values and the second gamma reference voltage VREF2, to the data lines D1 through Dm during the second period t2 of the horizontal period 1H. The data signals include the pre-emphasis voltage Vpre and the data voltage Vdata.

In more detail, at the rising edge of the data signals, a level of the pre-emphasis voltage Vpre is larger than a level of the data voltage Vdata. In addition, at the falling edge of the data signals, the level of the pre-emphasis voltage Vpre is smaller than the level of the data voltage Vdata.

The timing controller 10 controls the gamma reference voltage supplier 20 to supply the first gamma reference voltage VREF1 during the first period t1, and to supply the second gamma reference voltage VREF2 during the second period t2.

The timing controller 10 may determine the pre-emphasis grayscale values based on the look-up table 15, in which the pre-emphasis values corresponding to the image data value of the previous horizontal period and the image data value of the current horizontal period are identified (or stored). The intermediate values that are not identified in the look-up table 15 may be determined by an interlacing method.

For example, when the image data value of the current horizontal period has a grayscale value of 32 and the image data value of the previous horizontal period has the grayscale value of 32, the pre-emphasis value is determined to have the grayscale value of 32. Therefore, pre-emphasis is not actually driven.

When image data value of the current horizontal period has a grayscale value of 96 and the image data value of the previous horizontal period has a grayscale value of 0, the pre-emphasis value is determined to have a grayscale value of 129. That is, because a data voltage Vdata(n) of the current horizontal period is higher than a data voltage Vdata(n−1) of the previous horizontal period, the pre-emphasis is driven so that a level of a pre-emphasis voltage Vpre(n) of the current horizontal period is larger than a level of the data voltage Vdata(n). The pre-emphasis voltage Vpre(n) is supplied to the data lines during the first period t1 of the current horizontal period, and the data voltage Vdata(n) is supplied to the data lines during the second period t2 of the current horizontal period.

The timing controller 10 may control the gamma reference voltage supplier 20 to supply the second gamma reference voltage VREF2 during the data change between the intermediate grayscale levels, and to supply the first gamma reference voltage VREF1 during the data change between the lowest grayscale level and the highest grayscale level as a result of comparing the image data values.

In more detail, when it is determined that the image data value of the previous horizontal period is included in one of the low grayscale value group and the high grayscale value group, and the image data value of the current horizontal period is included in the other of the low grayscale value group and the high grayscale value group, the timing controller 10 may control the gamma reference voltage supplier 20 to supply the first gamma reference voltage VREF1 during the first period t1. Here, the low grayscale value group may include the lowest grayscale level and grayscale levels close to the lowest grayscale level, and the high grayscale value group may include the highest grayscale level and grayscale levels close to the highest grayscale level.

For example, when it is assumed that the low grayscale value group includes grayscale levels of 0 through 8, and the high grayscale value group includes grayscale levels of 224 through 255, in the case in which the image data value of the current horizontal period has the grayscale level of 255 and the image data value of the previous horizontal period has the grayscale level of 0, the pre-emphasis value is determined to have the grayscale level of 255. When the gamma reference voltage VREF is uniformly maintained, the pre-emphasis voltage Vpre(n) and the data voltage Vdata(n) of the current horizontal period have the same grayscale value.

Therefore, so that the pre-emphasis voltage Vpre(n) and the data voltage Vdata(n) of the current horizontal period have different levels, the gamma reference voltage supplier 20 supplies the first gamma reference voltage VREF1 during the first period t1, and supplies the second gamma reference voltage VREF2 during the second period t2.

The data driver 30 supplies the pre-emphasis voltage Vpre(n) generated based on the first gamma reference voltage VREF1 during the first period t1, and supplies the data voltage Vdata(n) generated based on the second gamma reference voltage VREF2 during the second period t2. A level of the highest gamma reference voltage of the first gamma reference voltage VREF1 may be larger than a level of the highest gamma reference voltage of the second gamma reference voltage VREF2.

For example, when the image data value of the current horizontal period has the grayscale level of 255, the data voltage Vdata(n) corresponding to the grayscale level of 255 becomes the second positive polar high gamma reference voltage VGMA_UH2 that is the highest gamma reference voltage of the second gamma reference voltage VREF2, and thus, a level of the second positive polar high gamma reference voltage VGMA_UH2 may be 16.5V.

When the image data value of the previous horizontal period has the grayscale level of 0, the pre-emphasis value is determined by the look-up table 15 to have the grayscale level of 255. The pre-emphasis voltage Vpre(n) corresponding to the grayscale level of 255 becomes the first positive polar high gamma reference voltage VGMA_UH1 that is the highest gamma reference voltage of the first gamma reference voltage VREF1, and thus, a level of the first positive polar high gamma reference voltage VGMA_UH1 may be 16.8V.

Therefore, although the pre-emphasis voltage Vpre(n) and the data voltage Vdata(n) of the current horizontal period have the same value of the grayscale level of 255, the level of the pre-emphasis voltage Vpre(n) of 16.8V is larger than the level of the data voltage Vdata(n) of 16.5V. Therefore, despite the data change between the highest grayscale level and the lowest grayscale level, the pre-emphasis voltage having the level that is larger than the level of the data voltage may be applied.

Figure 5:
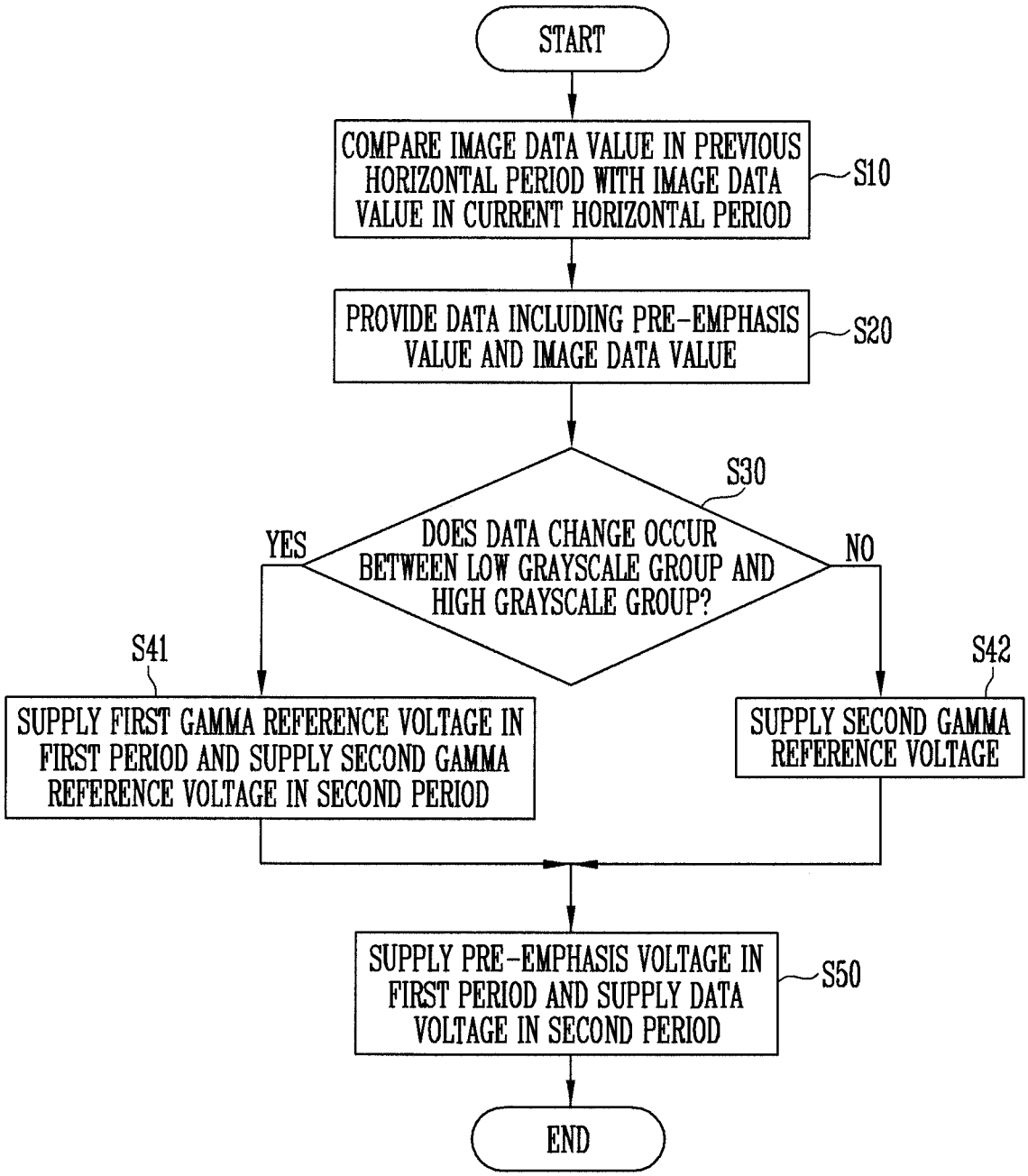
FIG. 5 is a flowchart illustrating a method of driving a display device according to an embodiment of the present invention.

FIG. 5 is a flowchart illustrating a method of driving a display device according to an embodiment of the present invention.

Referring to FIG. 5, in the method of driving the display device according to the embodiment of the present invention, first, the timing controller 10 compares the image data value of the previous horizontal period with the image data value of the current horizontal period in operation S10. In more detail, the timing controller 10 compares the image data value of the previous horizontal period with the image data value of the current horizontal period, and may determine the pre-emphasis value of the current horizontal period.

According to an embodiment, the timing controller 10 may determine the pre-emphasis grayscale values based on the look-up table 15 in which the pre-emphasis values corresponding to the image data value of the previous horizontal period and the image data value of the current horizontal period are identified (or stored).

The timing controller 10 provides the data DATA including the pre-emphasis values and the image data values to the data driver 30 in operation S20. The timing controller 10 corrects the image data input from the outside to be suitable for the image display of the pixel unit 50, and supplies the corrected data DATA to the data driver 30. The timing controller 10 may change some of the image data values into the determined pre-emphasis grayscale values.

In order to determine whether to supply the first gamma reference voltage VREF1, the timing controller 10 may determine whether a change occurs between the low grayscale values group and the high grayscale values group in operation S30. According to an embodiment, the timing controller 10 may control the gamma reference voltage supplier 20 to supply the second gamma reference voltage VREF2 during the data change between the intermediate grayscale values, and to supply the first gamma reference voltage VREF1 during the data change between the lowest grayscale value and the highest grayscale value as a result of comparing the image data values.

When it is determined in the operation S30 that the data change occurs between the low grayscale values group and the high grayscale values group, the gamma reference voltage supplier 20 supplies the first gamma reference voltage VREF1 to the data driver 30 during the first period, and supplies the second gamma reference voltage VREF2 to the data driver 30 during the second period in operation S41. According to an embodiment, when it is determined that the image data value of the previous horizontal period is included in one of the low grayscale values group and the high grayscale values group, and the image data value of the current horizontal period is included in the other of the low grayscale values group and the high grayscale values group, the timing controller 10 may control the gamma reference voltage supplier 20 to supply the first gamma reference voltage VREF1 during the first period.

When it is determined in the operation S30 that the data change does not occur between the low grayscale values group and the high grayscale values group, the gamma reference voltage supplier 20 supplies the second gamma reference voltage VREF2 to the data driver 30 in operation S42. That is, the timing controller 10 may control the gamma reference voltage supplier 20 to not supply the first gamma reference voltage VREF1, and to continuously supply the second gamma reference voltage VREF2 during the data change between the intermediate grayscale values as a result of comparing the image data values.

Next, the data driver 30 supplies the pre-emphasis voltage to the data lines D1 through Dm during the first period, and supplies the data voltage to the data lines D1 through Dm during the second period in operation S50. When the first gamma reference voltage VREF1 and the second gamma reference voltage VREF2 are sequentially supplied, the data driver 30 supplies the pre-emphasis voltage generated based on the first gamma reference voltage VREF1 during the first period, and supplies the data voltage generated based on the second gamma reference voltage VREF2 during the second period. When only the second gamma reference voltage VREF2 is supplied, the data driver 30 supplies the pre-emphasis voltage generated based on the second gamma reference voltage VREF2 during the first period, and supplies the data voltage generated based on the second gamma reference voltage VREF2 during the second period.

As described above, according to one or more embodiments of the present invention, the pre-emphasis voltage generated based on the first gamma reference voltage VREF1 is supplied during the first period of the horizontal period, and the data voltage generated based on the second gamma reference voltage VREF2 different from the first gamma reference voltage VREF1 is supplied during the second period, so that the pre-emphasis voltage having a level that is larger than the level of the data voltage may be applied despite of the data change between the highest grayscale level and the lowest grayscale level.

Therefore, it may be possible to increase a charge rate of the display device, and to improve picture quality of the display device.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Example embodiments have been described herein, and although specific terms are employed, they are used and are to be interpreted in a generic and descriptive sense only, and not for purpose of limitation. In some examples, as would be apparent to one of ordinary skill in the art, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and details may be made without departing from the spirit and scope of the present invention, as set forth in the following claims and their equivalents.

What is claimed is:

1. A display device comprising:

a timing controller configured to provide data including a pre-emphasis value and an image data value;

a gamma reference voltage supplier configured to selectively supply one of a first gamma reference voltage and a second gamma reference voltage different from the first gamma reference voltage; and a data driver configured to supply a pre-emphasis voltage, that is generated based on the pre-emphasis value and the first gamma reference voltage, to data lines during a first period of a horizontal period, and to supply a data voltage, that is generated based on the image data value and the second gamma reference voltage, to the data lines during a second period of the horizontal period, wherein the timing controller is configured to control the gamma reference voltage supplier to supply the first gamma reference voltage during the first period and to supply the second gamma reference voltage during the second period.

2. The display device of claim 1, wherein each of the first and second gamma reference voltages comprises a lowest gamma reference voltage corresponding to a low grayscale value, and a highest gamma reference voltage corresponding to a high grayscale value.

3. The display device of claim 2, wherein the lowest gamma reference voltage of the first gamma reference voltage is lower in level than the lowest gamma reference voltage of the second gamma reference voltage, and wherein the highest gamma reference voltage of the first gamma reference voltage is higher in level than the highest gamma reference voltage of the second gamma reference voltage.

4. The display device of claim 1, wherein the timing controller is configured to compare the image data value of a previous horizontal period with the image data value of a current horizontal period, and to determine the pre-emphasis value of the current horizontal period.

5. The display device of claim 4, wherein the timing controller is configured to control the gamma reference voltage supplier to supply the first gamma reference voltage during the first period when a difference between the image data value of the previous horizontal period and the image data value of the current horizontal period is greater than or equal to a reference value, and to supply the second gamma reference voltage during the first period when the difference between the image data value of the previous horizontal period and the image data value of the current horizontal period is less than the reference value.

6. The display device of claim 1, wherein the timing controller is configured to determine pre-emphasis values based on a look-up table in which the pre-emphasis values corresponding to the image data value of a previous horizontal period and the image data value of a current horizontal period are stored.

7. The display device of claim 6, wherein the look-up table comprises a low grayscale values group including a lowest grayscale value, and a high grayscale values group including a highest grayscale value.

8. The display device of claim 7, wherein the timing controller is configured to control the gamma reference voltage supplier to supply the first gamma reference voltage during the first period, when it is determined that the image data value of the previous horizontal period is included in one of the low grayscale values group and the high grayscale values group, and the image data value of the current horizontal period is included in the other ones of the low grayscale values group and the high grayscale values group.

9. The display device of claim 1, wherein the data driver comprises a grayscale voltage generator configured to divide the first gamma reference voltage or the second gamma reference voltage, and to generate a plurality of grayscale voltages.

10. The display device of claim 9, wherein the data driver is configured to generate the pre-emphasis voltage by selecting one of the grayscale voltages from among the grayscale voltages corresponding to the pre-emphasis value, and to generate the data voltage by selecting one of the grayscale voltages from among the grayscale voltages corresponding to the image data value.

11. The display device of claim 1, further comprising:

a gate driver configured to supply gate signals through gate lines; and a pixel unit including a plurality of pixels connected to the gate lines and the data lines.

12. A method of driving a display device, the method comprising:

providing data including a pre-emphasis value and an image data value;

selectively supplying a first gamma reference voltage and a second gamma reference voltage different from the first gamma reference voltage; and supplying a pre-emphasis voltage, that is generated based on the pre-emphasis value and the first gamma reference voltage, to data lines during a first period of a horizontal period, and supplying a data voltage generated, that is based on the image data value and the second gamma reference voltage, to the data lines during a second period of the horizontal period, wherein, in the selectively supplying of the first gamma reference voltage and the second gamma reference voltage, the first gamma reference voltage is supplied during the first period, and the second gamma reference voltage is supplied during the second period.

13. The method of claim 12, wherein each of the first and second gamma reference voltages comprises a lowest gamma reference voltage corresponding to a low grayscale value and a highest gamma reference voltage corresponding to a high grayscale value.

14. The method of claim 13, wherein the lowest gamma reference voltage of the first gamma reference voltage is lower in level than the lowest gamma reference voltage of the second gamma reference voltage, and wherein the highest gamma reference voltage of the first gamma reference voltage is higher in level than the highest gamma reference voltage of the second gamma reference voltage.

15. The method of claim 12, further comprising determining pre-emphasis values based on a look-up table in which the pre-emphasis values corresponding to the image data value of a previous horizontal period and the image data value of a current horizontal period are stored.

16. The method of claim 15, wherein the look-up table comprises a low grayscale values group including a lowest grayscale value, and a high grayscale values group including a highest grayscale value.

17. The method of claim 16, wherein, the selectively supplying of the first gamma reference voltage and the second gamma reference voltage comprises supplying the first gamma reference voltage during the first period, when it is determined that the image data value of the previous horizontal period is included in one of the low grayscale values group and the high grayscale values group, and the image data value of the current horizontal period is included in the other ones of the low grayscale values group and the high grayscale values group.

18. A system of driving a display device, the system comprising:

means for providing data including a pre-emphasis value and an image data value;

means for selectively supplying a first gamma reference voltage and a second gamma reference voltage different from the first gamma reference voltage; and means for supplying a pre-emphasis voltage, that is generated based on the pre-emphasis value and the first gamma reference voltage, to data lines during a first period of a horizontal period, and supplying a data voltage generated, that is based on the image data value and the second gamma reference voltage, to the data lines during a second period of the horizontal period, wherein, in the selectively supplying of the first gamma reference voltage and the second gamma reference voltage, the first gamma reference voltage is supplied during the first period, and the second gamma reference voltage is supplied during the second period.

* * * * *